US007014288B2

(12) United States Patent
Maeda

(10) Patent No.: US 7,014,288 B2
(45) Date of Patent: Mar. 21, 2006

(54) RECORDING APPARATUS AND CONTROL METHOD THEREFOR

(75) Inventor: Masao Maeda, Kanagawa (JP)

(73) Assignee: Canon Kabushiki kaisha, Tokyo (JP)

( * ) Notice: Subject to any disclaimer, the term of this patent is extended or adjusted under 35 U.S.C. 154(b) by 246 days.

(21) Appl. No.: 10/648,869

(22) Filed: Aug. 27, 2003

(65) Prior Publication Data

US 2004/0041861 A1 Mar. 4, 2004

(30) Foreign Application Priority Data

Aug. 27, 2002 (JP) ..... 2002-247478

(51) Int. Cl.
*B41J 29/38* (2006.01)

(52) U.S. Cl. ..... 347/16; 347/14

(58) Field of Classification Search ..... 347/12, 347/16, 9, 14

See application file for complete search history.

(56) References Cited

U.S. PATENT DOCUMENTS 6,517,267 B1 * 2/2003 Otsuki ..... 400/124.01

* cited by examiner

*Primary Examiner*—K. Feggins
*Assistant Examiner*—Julian D. Huffman
(74) *Attorney, Agent, or Firm*—Morgan & Finnegan, L.L.P.

(57) ABSTRACT

A recording apparatus comprising a shift register which shifts recording data stored in a buffer memory, by a designated magnitude corresponding to a designated number of the recording elements, and which then transfers the recording data to a recording head. In a case where a region which cannot be record-scanned by the recording head exists in a region near the end part of a recording medium in a sub scanning direction, and where the relative position of the recording head and the recording medium in the sub scanning direction cannot be renewed, the shift register is controlled so that the recording data to be transferred to the recording head may be shifted onto the side of the region which cannot be record-scanned, in the sub scanning direction.

15 Claims, 7 Drawing Sheets

RECORDING APPARATUS AND CONTROL METHOD THEREFOR

This application claims priority from Japanese Patent Application No. 2002-247478 filed Aug. 27, 2002, which is incorporated hereinto by reference.

BACKGROUND OF THE INVENTION

1. Field of the Invention

The present invention relates to a recording apparatus and a control method therefor, and more particularly to a recording apparatus which performs recording on a recording medium while repeating a main scanning operation of record-scanning with a recording head having a plurality of recording elements, in a main scanning direction, and a sub scanning operation of relatively moving the recording head and a recording medium in a sub scanning direction orthogonal to the main scanning direction.

2. Description of the Related Art

By way of example, in a prior-art recording apparatus of the scheme in which a recording medium is conveyed, there has been generally employed a configuration wherein a paper feed port for setting recording media is provided on an upper stream side in a conveyance direction in a recording mode, on the conveyance path of the recording medium, the recording medium is conveyed in the same direction as the conveyance direction in the recording mode, thereby to subject the recording medium to an edge positioning operation to a recording start position, and after the end of recording, the recording medium is conveyed in the same direction as the conveyance direction in the recording mode, thereby to eject the recording medium to a paper ejection port provided on a lower stream side in the conveyance direction. The "edge positioning operation" termed in this specification means the operation of relatively moving the recording medium and a recording head in a sub scanning direction, to a heading position which is the recording start position.

However, it is sometimes desirable from the viewpoint of a handling utility for a user that both a paper ejection port and a paper feed port are provided in an identical surface (for example, the front surface of a recording apparatus). Considered as a technique for realizing such a configuration is a structure in which the conveyance path of a recording medium extending from the paper feed port to the paper ejection port is U-turned inside the recording apparatus. It is very difficult, however, to construct a U-turn path so that some kinds of recording media, for example, thick paper and an envelope may also be reasonably passed. On the other hand, considered as a technique for realizing the front paper feed and ejection without requiring the U-turn is a method in which recording media are set on the side of the paper ejection port, and a recording medium is drawn in a direction reverse to a conveyance direction in a recording mode so as to be subjected to a conveyance operation to the heading position thereof, whereupon recording is started.

However, in case of the method in which the recording medium is drawn in the direction reverse to the conveyance direction in the recording mode, a conveyance amount in which the recording medium can be drawn is sometimes limited on account of restrictions in layout inside the recording apparatus. For this reason, there is a problem that an unrecordable region appears at the front end part of the recording medium, depending upon the size of the recording medium. In other words, a record-scannable region is limited at the front end part of the recording medium.

This problem is involved, not only in the recording apparatus wherein the recording media are set on the side of the paper ejection port, and the recording medium is drawn in a direction reverse to the conveyance direction in the recording mode so as to be subjected to the conveyance operation to the heading position thereof, followed by the recording, but also in any recording apparatus wherein a record-scannable region is sometimes limited in a region near an end part (front end part or rear end part) in the sub scanning direction of the recording medium.

The present invention has been made in order to solve the above problem, and it provides a recording apparatus in which, even when a record-scannable region is limited at an end part (or in a region near the end part) in the sub scanning direction of a recording medium, recording can be performed by extending a recordable region at the end part to the maximum and reducing a margin to the utmost, and a control method for the recording apparatus.

SUMMARY OF THE INVENTION

There is provided a recording apparatus which performs recording on a recording medium while repeating a main scanning operation of record-scanning with a recording head having a plurality of recording elements arrayed in a predetermined direction, in a main scanning direction substantially orthogonal to the predetermined direction, and a sub scanning operation of relatively moving the recording head and the recording medium in a sub scanning direction orthogonal to the main scanning direction, comprising:

shift means capable of shifting, by a magnitude corresponding to a designated number of the recording elements, recording data stored in a buffer memory, and then transferring the recording data to the recording head; and control means for controlling the shift means so that; in a case where a region which cannot be record-scanned by the recording head exists in a region near an end part of the recording medium in the sub scanning direction, and where a relative position of the recording head and the recording medium in the sub scanning direction cannot be renewed, the recording data to be transferred to the recording head may be shifted by the shift means onto a side of the region which cannot be record-scanned in the sub scanning direction.

In the recording apparatus and the control method therefor according to the present invention, even when a record-scannable region is limited at an end part in the subscanning direction of a recording medium, it is permitted to perform recording with a recordable region at the end part extended to the maximum and with a margin reduced to the utmost.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, embodiments of the present invention will be described in detail with reference to the drawings. In the embodiments, a recording apparatus which functions so that, after recording media have been set on the side of a paper ejection port, a recording medium is drawn in a direction reverse to a conveyance direction in a recording mode so as to be subjected to a conveyance operation to the heading position thereof, followed by recording, will be taken as an example and will have its operation described. However, the present invention shall not be restricted to such an example as stated above. That is, the present invention is applicable to any recording apparatus wherein a record-scannable region could be limited in a region near an end part (near a front end part or near a rear end part) in the sub scanning direction of the recording medium.

Accordingly, although the conveyance of the recording medium will be referred to in the following embodiments, the present invention achieves similar advantages when applied to the relative movement between a recording head and the recording medium.

<Example of Structure of Recording Apparatus in this Embodiment>

Figure 1:
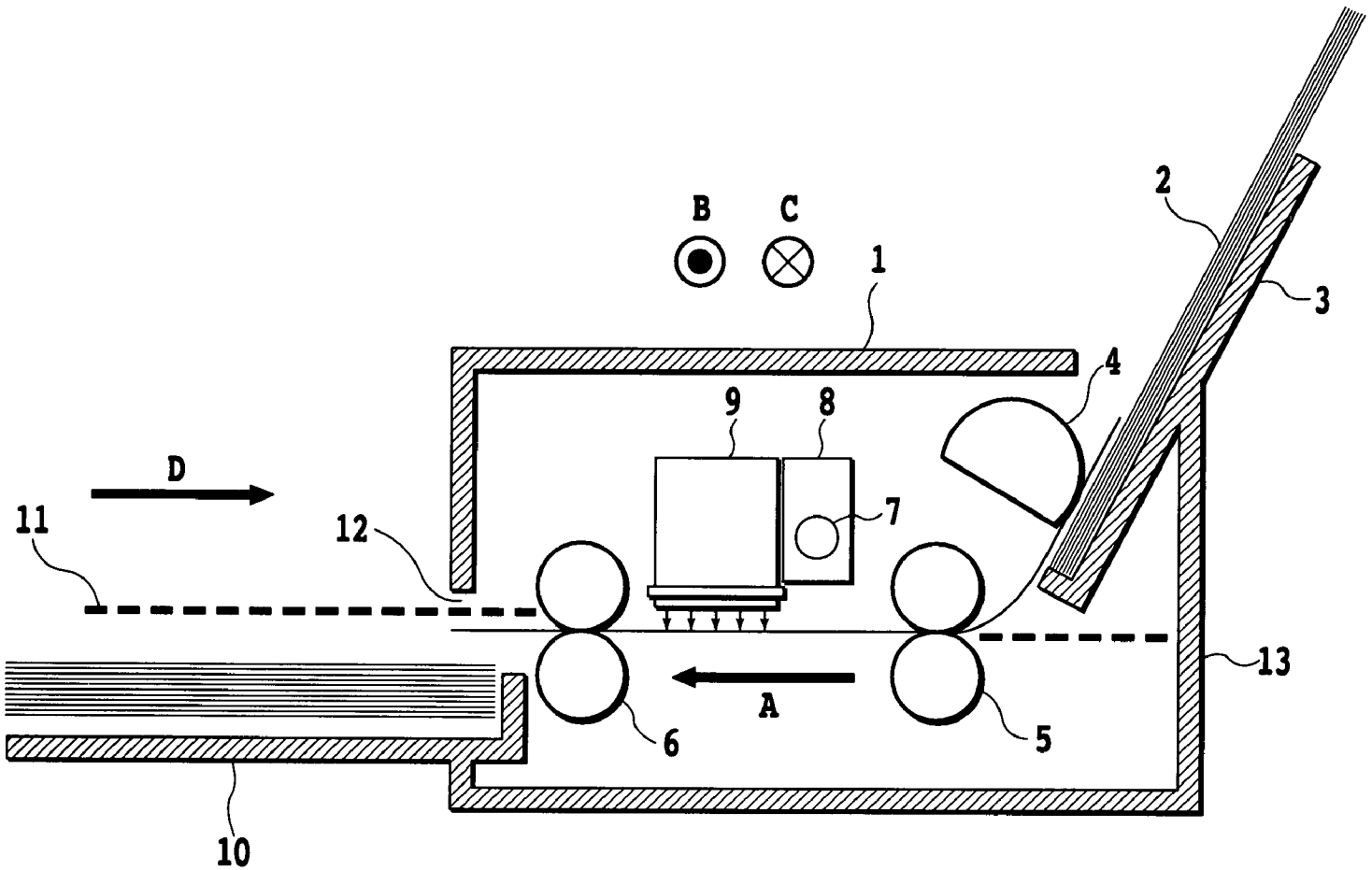
FIG. 1 is a schematic view showing the construction of a recording apparatus in an embodiment of the present invention.

FIG. 1 is a schematic view showing the structure of an example of a recording apparatus in this embodiment.

Sheets of recording paper 2 are stacked on a paper feed tray 3, and they are picked up one by one by a paper feed roller 4. The recording paper 2 picked up by the paper feed roller 4 is then supported and is conveyed in a direction of an arrow A by conveyance rollers 5, 6 which are driven by a not shown conveyance motor. A guide shaft 7 is disposed between the conveyance rollers 5 and 6 and in parallel with them, and a carriage 8 reciprocates in a direction of an arrow B (advancing perpendicularly from the sheet of the drawing) and a direction of an arrow C (advancing perpendicularly toward the sheet of the drawing) on the guide shaft 7. A recording head 9 is mounted on the carriage 8. A recording operation for one scanning is performed in such a way that, while the carriage 8 is being moved by a carriage motor not shown, drive pulses are impressed on the recording head 9. The recording paper 2 is conveyed by a predetermined amount in the direction of the arrow A by the conveyance rollers 5, 6 every record-scanning of the carriage 8. Recording for one page of the recording paper 2 is completed by repeating such record-scannings and conveyance operations. The recording paper 2 after the completion of the recording is subsequently conveyed in the direction of the arrow A by the conveyance rollers 5, 6 until it is ejected and stacked onto an ejection tray 10.

On the other hand, in a case where recording is performed on a board-like recording medium 11 such as compact disk or glass plate, the medium 11 is set by causing it to abut against the conveyance rollers 6 from an opening 12 provided on the side of the ejection tray 10. The board-like recording medium 11 is conveyed in a direction of an arrow D by driving the conveyance rollers 5, 6 in the reverse directions, until it is conveyed to a position nearly colliding against a side board 13 located on the side of the paper feed tray 3. Subsequently, the recording is performed by repeating record-scannings and conveyance operations in the direction of the arrow A from the position in the same manner as in the regular recording. The board-like recording medium 11 after the completion of the recording is subsequently conveyed in the direction of the arrow A by the conveyance rollers 5, 6 until it is ejected from the opening 12 provided on the side of the ejection tray 10.

Figure 2:
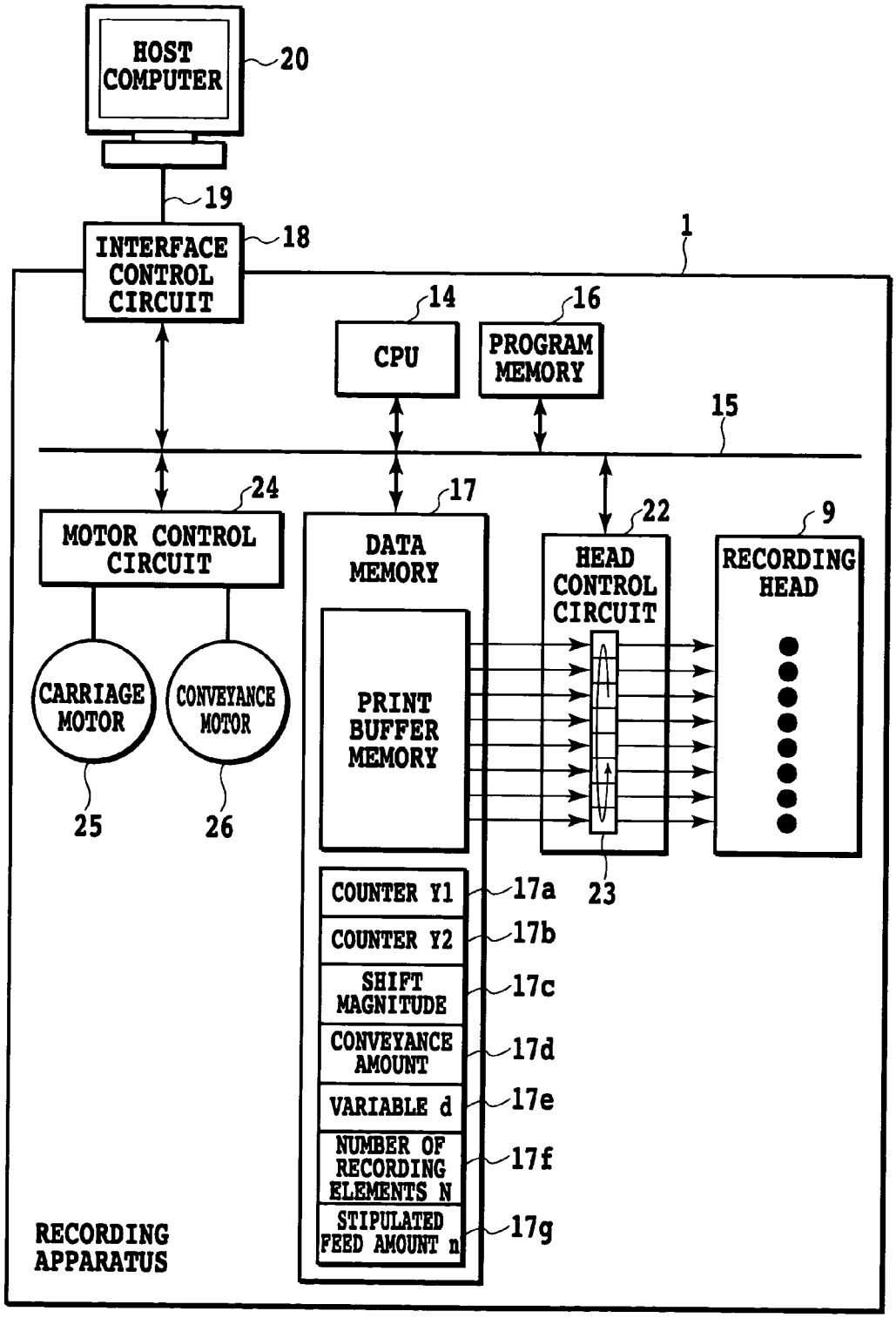
FIG. 2 is a block diagram showing the control system of the recording apparatus in an embodiment of the present invention.

FIG. 2 is a block diagram showing the control system of the recording apparatus in this embodiment.

A CPU 14 in a form of a microprocessor is connected to a program memory 16 in a form of a ROM and a data memory 17 in a form of a RAM through an internal bus 15. The CPU 14 operates in accordance with a control program stored in the program memory 16, and the contents of the data memory 17. The CPU 14 receives recording data from a host computer 20 connected by an interface cable 19, through an interface control circuit 18, and stores the recording data in a print buffer memory 21 included in the data memory 17. The recording data expanded in the print buffer memory 21 are read out by a head control circuit 22, and are sent to the recording head 9. In addition to the area of the print buffer memory 21, the data memory 17 reserves, for example, the area 17*a* of a counter Y1, the area 17*b* of a counter Y2, the storage area 17*c* of a shift magnitude, the storage area 17*d* of a conveyance amount, the storage area 17*e* of a variable d, the storage area 17*f* of the number of recording elements N, and the storage area 17*g* of a stipulated feed amount n. It should be noted that it is also allowed to employ a construction in which a control program is downloaded from the host computer 20 or an external storage medium such as disk not shown, into the data memory 17, so as to be run by the CPU 14.

A shift register 23 is disposed in the head control circuit 22. When the print data read out from the print buffer memory 21 are to be sent to the recording head 9, they are shifted by the shift register 23, whereby those recording elements of the recording head 9 which are to be used can be shifted. The CPU 14 is also capable of controlling a carriage motor 25 and a conveyance motor 26 through a motor control circuit 24, and recording is performed by combining and controlling these operations.

<Example of Control of Recording Apparatus in this Embodiment>

Figure 3:
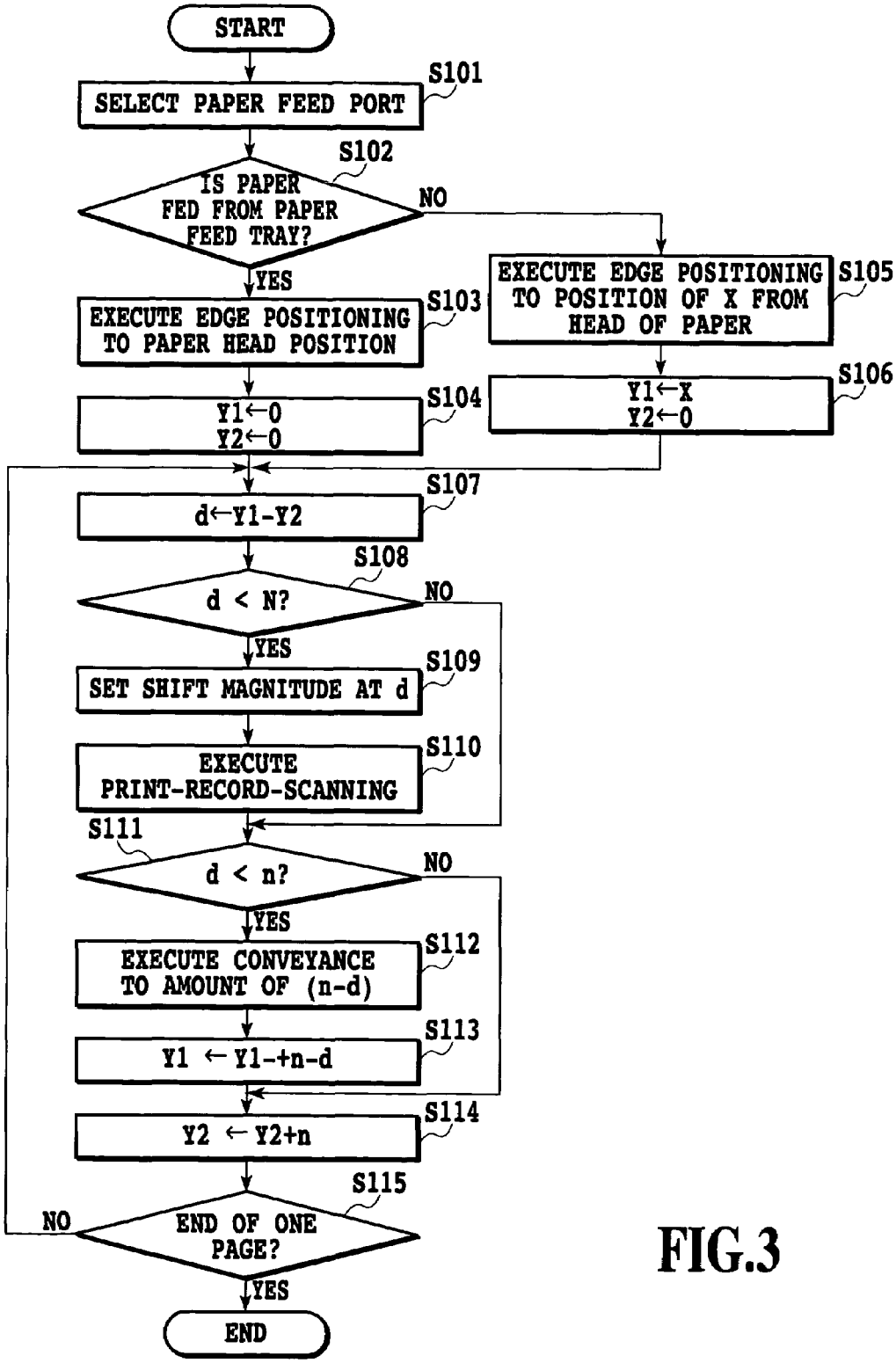
FIG. 3 is a flow chart showing the processing contents of a CPU 14 in an embodiment of the present invention.

FIG. 3 is a flow chart showing contents of processes performed by the CPU 14 in this embodiment.

At step S101, the CPU 14 selects the paper feed port in accordance with the contents of recording data or a user's manipulation as received from the host computer 20. In a case where paper is fed from the side of the paper feed tray upon a judgment at step S102, an edge positioning operation is executed to the head position of the paper (step S103). The counter Y1 provided in the data memory 17 is cleared to "0", and the counter Y2 is also cleared to "0" (step S104).

On the other hand, in a case where paper is fed from the side of the paper ejection port, not from the paper feed tray, an edge positioning operation is executed to a position at which the recording medium shifts from the head of the paper onto a lower stream side in a conveyance direction by a predetermined distance X (step S105). The counter Y1 is set at "X", and the counter Y2 is set at "0" (step S106). Subsequently, the CPU 14 turns to record-scanning processing, at and after which common processing steps are executed without regard to the paper feed port to-be-used. In this manner, the execution of the edge positioning and the setting of the counter Y1 are merely changed, and other processing steps are common without regard to the paper feed port to-be-used, so that the program uses a small memory capacity and can be easily installed.

At step S107, the CPU 14 calculates the difference between the values of the counter Y1 and counter Y2, and it stores this difference as the variable d in the storage area 17*e* within the data memory 17 (step S107). In a case where the variable d is not less than the number N of the recording elements of the recording head at step S108, the routine of the CPU 14 proceeds to step S111, and the execution of record-scanning is skipped. In a case where the variable d is less than the number N of the recording elements, this variable d is set as the magnitude of the shift which is made in the shift register 23 included in the head control circuit 22 (step S109), and the record-scanning of one scan is executed (step S110).

Next, the routine of the CPU 14 proceeds to the step S111 so as to check if the variable d is less than the feed amount n stipulated for every scan. In a case where the variable d is not less than the amount n, the routine directly proceeds to step S114, and the conveyance operation of the recording medium is skipped. In a case where the variable d is less than the amount n, the conveyance operation of the recording medium is executed to the amount of (n−d) (step S112), and the counter Y1 is incremented by (n−d) (step S113). Subsequently, the CPU 14 increments the counter Y2 by n (step S114), and the record-scanning processing for one scan is ended.

The above steps are repeated till the end of one page (step S115), whereby the recording for the recording medium is completed.

<Practicable Example 1 of Operation of Recording Apparatus in this Embodiment>

Figure 4:
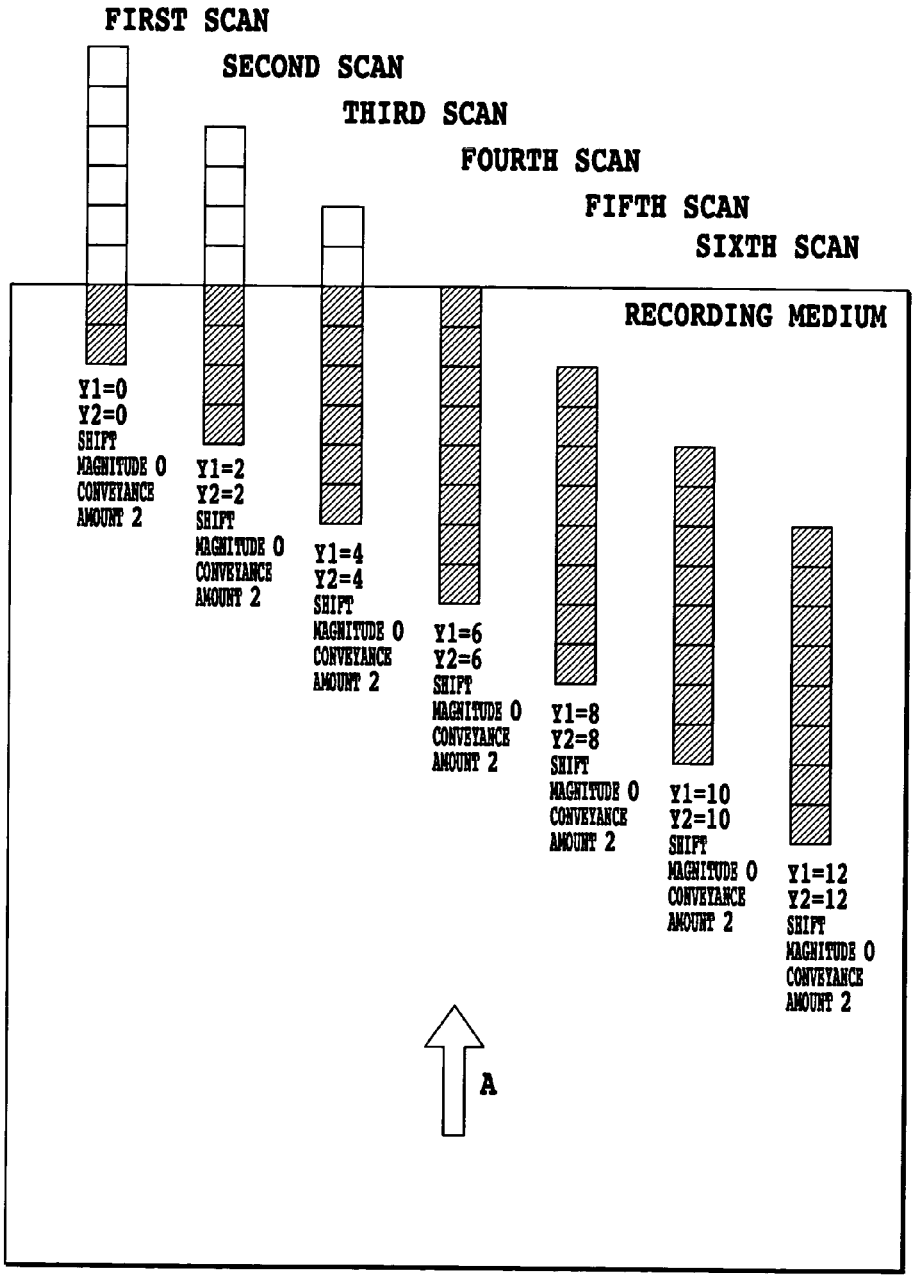
FIG. 4 is a conceptual diagram showing an example of record-scanning in the case where paper is fed from a paper feed tray.

FIG. 4 shows a situation where record-scanning is performed in a case where paper is fed from the paper feed tray in this embodiment. Here, a case of employing the recording head 9 which has eight recording elements, that is, a case of N=8 is supposed, and the recording medium is conveyed by a distance corresponding to the length of two recording elements every record-scanning. That is, here shown is a case where the stipulated feed amount is n=2.

After the recording medium has been conveyed to its head position being a recording start position, recording is performed by repeating record-scannings while the conveyance operation corresponding to the stipulated feed amount of every two recording elements is being performed.

As shown in FIG. 4, since d=Y1−Y2 is always "0", the shift magnitude is "0", and the conveyance amount is always "2". Besides, the number N of the recording elements is "8", and the stipulated feed amount n is "2", so that an identical line is scanned by the elements four (=8/2) times.

Figure 5:
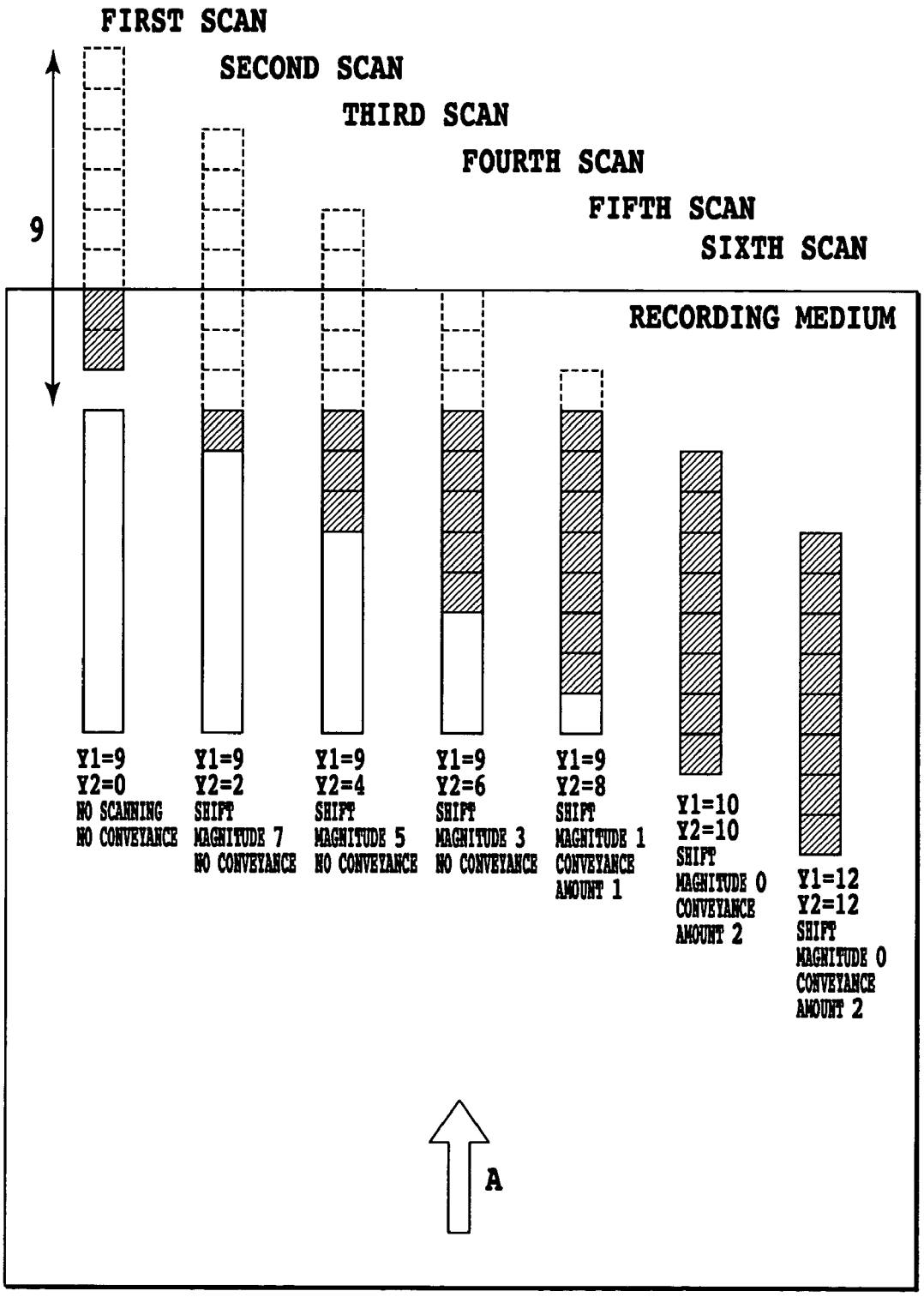
FIG. 5 is a conceptual diagram showing an example of record-scanning in the case where paper is fed from the side of a paper ejection port.

FIG. 5 shows a situation where record-scanning is performed in a case where paper is fed from the side of the paper ejection port in this embodiment. Shown here is the situation of the record-scanning in the case where the recording medium can be drawn only to a position which lies on the lower stream side in the conveyance direction for nine recording elements, as compared with the head position in the case where the paper is fed from the side of the paper feed tray.

At the processing time point of the first scan, the difference between the values of the counters Y1 and Y2 is d=9, and it is not less than the number N=8 of the recording elements of the recording head 9, so that the record-scanning is not performed here. Besides, since the difference d=9 is not less than the stipulated feed amount n=2, the conveyance operation of the recording medium is not performed, either. At the processing time point of the second scan, the difference becomes d=7, so that the record-scanning is performed with the shift magnitude set at 7 in the shift register 23. However, since the difference d=7 is not less than the stipulated feed amount n=2, the conveyance operation of the recording medium is not performed. Thenceforth, up to the fourth scan, only the record-scannings are performed without performing the conveyance operation of the recording medium, changing the shift magnitude.

At the processing time point of the fifth scan, the difference becomes d=1, so that the record-scanning is performed with the shift magnitude set at 1 in the shift register 23. Since the difference d=1 is less than the stipulated feed amount n=2, this record-scanning is followed by the conveyance operation of the recording medium by n−d=1. In the subsequent scans, the difference becomes d=0, so that recording is performed by repeating the record-scannings while the conveyance operation corresponding to the stipulated feed amount is being performed, as in the recording mode from the side of the paper feed tray.

It should be noted that as understood by comparing FIGS. 4 and 5, the same recording data can be recorded at the same positions of both the recording media from the front ends thereof though a margin appears at the head of the recording medium in the example of FIG. 5.

<Practicable Example 2 of Operation of Recording Apparatus in this Embodiment>

Figure 6:
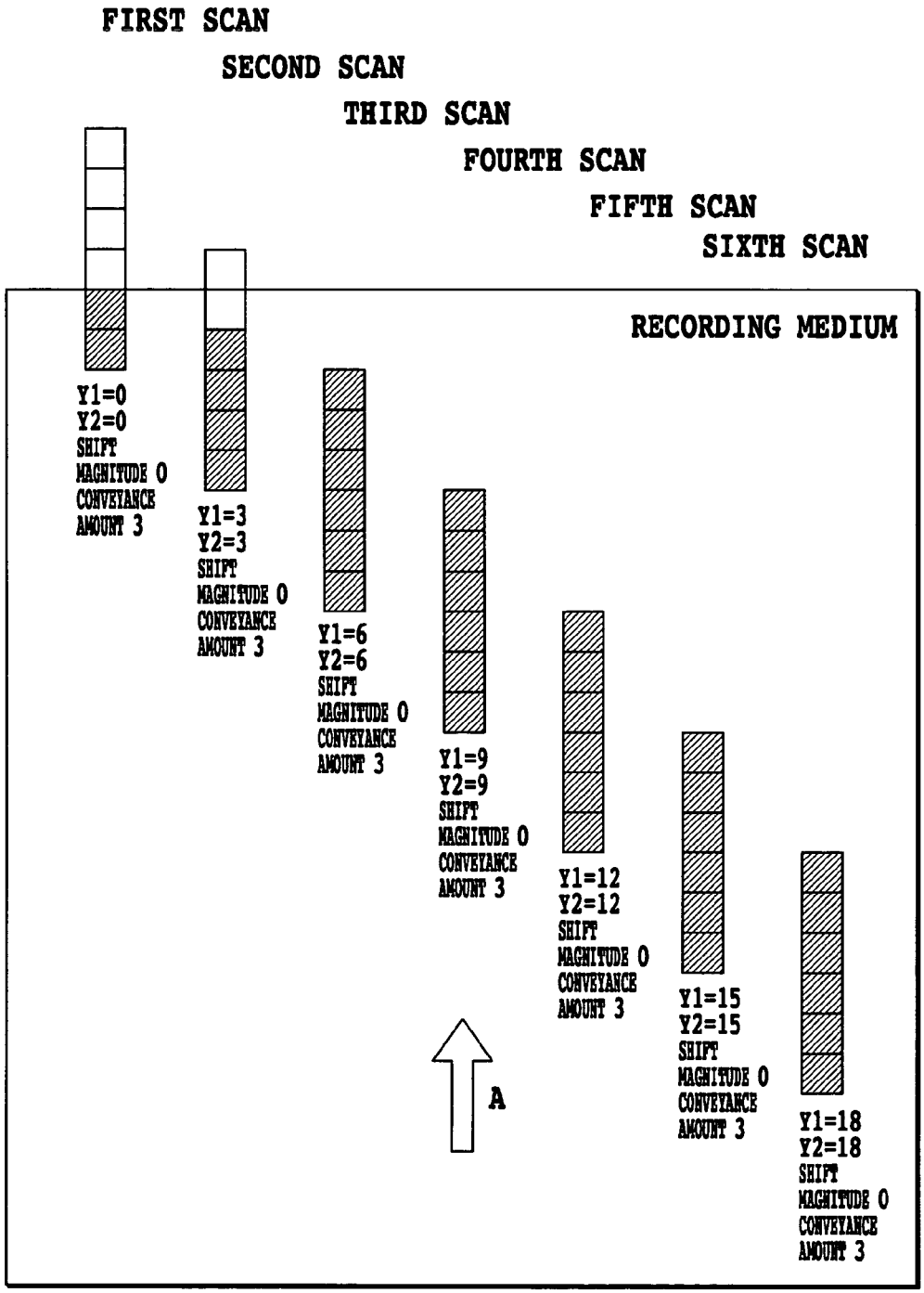
FIG. 6 is a conceptual diagram showing another example of record-scanning in the case where paper is fed from the paper feed tray.

FIG. 6 is a diagram showing another example of the situation where record-scanning is performed in the case where paper is fed from the paper feed tray in this embodiment. Here, a case where the recording head 9 has six recording elements, that is, a case of N=6 is shown, and the recording medium is conveyed by a distance corresponding to the length of three recording elements for every record-scanning. That is, here shown is a case where the stipulated feed amount is n=3.

After the recording medium has been conveyed to its head position being a recording start position, recording is performed by repeating record-scannings while the conveyance operation corresponding to the stipulated feed amount for every three recording elements is being performed.

As shown in FIG. 6, since d=Y1−Y2 is always "0", the shift magnitude is "0", and the conveyance amount is always "3". Besides, the number N of the recording elements is "6", and the stipulated feed amount n is "3", so that an identical line is scanned by the elements twice (=6/3).

Figure 7:
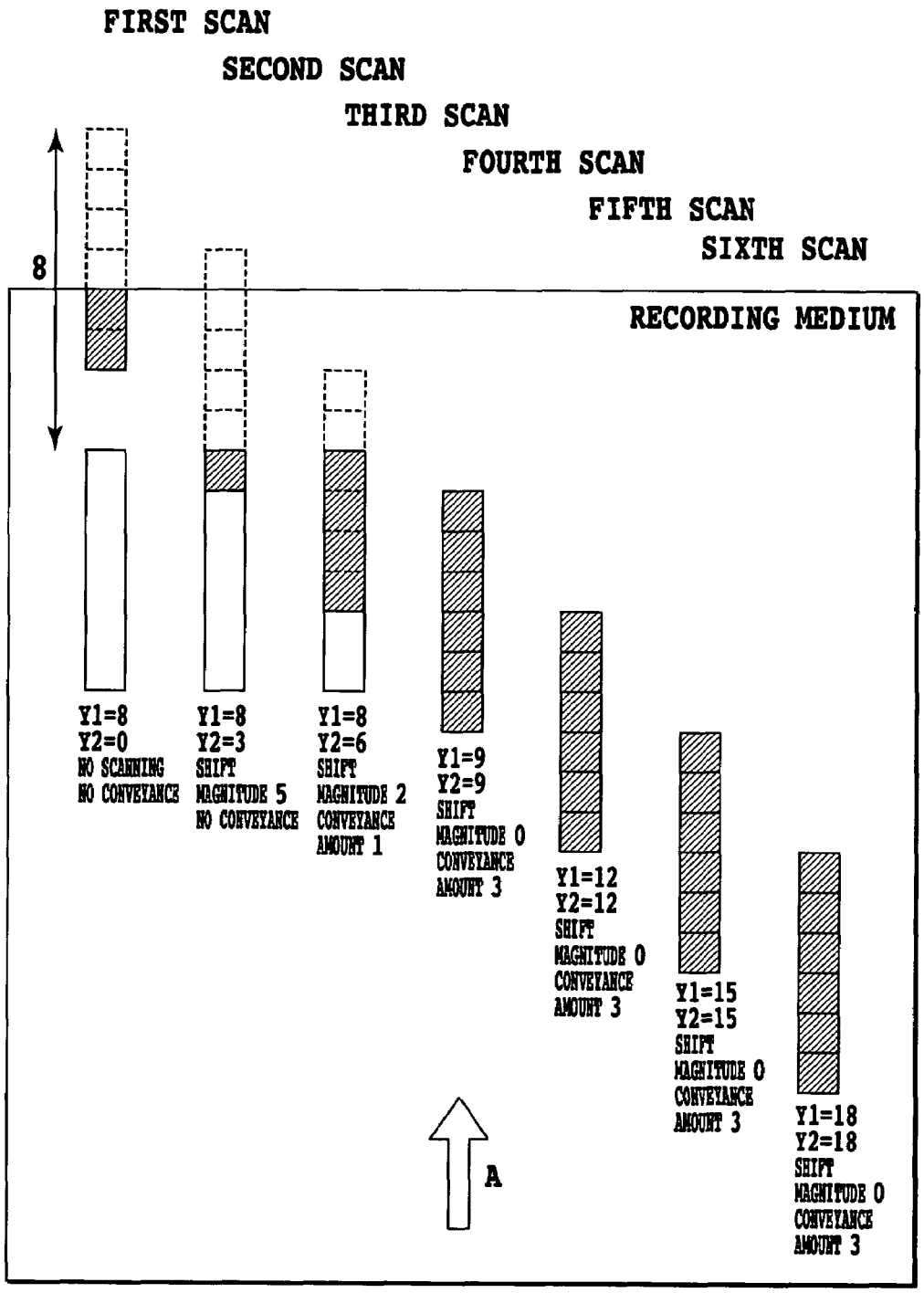
FIG. 7 is a conceptual diagram showing another example of record-scanning in the case where paper is fed from the side of the paper ejection port.

FIG. 7 shows a situation where record-scanning is performed in a case where paper is fed from the side of the paper ejection port in this embodiment. Shown here is the situation of the record-scanning in the case where the recording medium can be drawn only to a position which lies on the lower stream side in the conveyance direction for eight recording elements, as compared with the heading position in the case where the paper is fed from the side of the paper feed tray.

At the processing time point of the first scan, the difference between the values of the counters Y1 and Y2 is d=8, and it is not less than the number N=6 of the recording elements of the recording head 9, so that the record-scanning is not performed here. Besides, since the difference d=8 is not less than the stipulated feed amount n=3, the conveyance operation of the recording medium is not performed, either. At the processing time point of the second scan, the difference becomes d=5, so that the record-scanning is performed with the shift magnitude set at 5 in the shift register 23. However, since the difference d=5 is not less than the stipulated feed amount n=3, the conveyance operation of the recording medium is not performed.

At the processing time point of the third scan, the difference becomes d=2, and hence, the record-scanning is performed with the shift magnitude set at 2 in the shift register 23. After the record-scanning, the difference d=2 is less than the stipulated feed amount n=3, so that the conveyance operation of the recording medium is performed by n−d=1. In the subsequent scans, the difference becomes d=0, so that recording is performed by repeating the record-scannings while the conveyance operation corresponding to the stipulated feed amount is being performed, as in the recording mode from the side of the paper feed tray.

It should be noted that as understood by comparing FIGS. 6 and 7, as in the practicable example 1, the same recording data can be recorded at the same positions of both the recording media from the front ends thereof though a margin appears at the head of the recording medium in the example of FIG. 7.

<Advantages of this Embodiment>

Owing to the processing as described above, recording can be performed with a recordable region extended to the maximum, even in a case where a record-scannable region is limited at the front end part of a recording medium, such as in the case where the recording is performed by feeding the recording medium from the paper ejection side. Besides, as shown in the flow chart of FIG. 3, in the case of feeding the paper from the side of the paper feed tray and in the case of feeding the paper from the paper ejection side, the processing steps in both cases need not be different at all at the step of executing the record-scanning, et seq., after the edge positioning operation of the recording medium to the recording start position has been executed, so that the program is small in size and in memory capacity used and is easily altered. Moreover, even when the marginal sizes of the recording media at the head parts thereof have become different, a region to be recorded on can be controlled so that the recording data may be recorded at quite the same positions of the recording media, irrespective of whether the paper has been fed from the side of the paper feed tray or from the paper ejection side.

<Practicable Example of Operation of Recording Apparatus in another Embodiment>

When directions in each of FIGS. 4 through 7 referred to before are reversed, processing in the case where an unrecordable region exists at a recording terminal end is shown. Likely examples in which the processing is effective include the case where the recording is performed in the direction of the paper feed from the side of the paper ejection port in the recording apparatus of this embodiment, as well as the case where the recording medium is not conveyed but the recording head is moved in the sub scanning direction.

In this case for which a flow chart is not shown, when the scans are reversely traced in FIG. 5 by way of example, the processing of the front end part as shown in the flow chart of FIG. 3 has already ended at the time point at which the sixth scan is performed, and hence, the counters Y1 and Y2 have equal values. Since the stipulated feed amount n=2 is impossible after the end of the sixth scan, the conveyance execution amount (=1) is added to the value of the counter Y1, and the stipulated feed amount n=2 is successively added to the value of the counter Y2, so as to shift the recording data to the amount of the difference until the difference between the values of the counters Y2 and Y1 exceeds 8. Thus, it is permitted to spread the recordable region at the recording terminal end to the maximum, and to perform recording free from a useless margin.

More specifically, at the fifth scan, the recording medium is conveyed for one recording element to the final end, and the difference is d=1 (=2−1) which is less than 8, so that record-scanning is performed with the shift magnitude set at 1 in the shift register 23. After this, no conveyance is performed, and the shift magnitude is 3 on the basis of the difference d=3 (=4−1) at the fourth scan, it is 5 at the third scan, and it is 7 at the second scan. Besides, at the first scan, the difference becomes d=9 which exceeds 8, so that no record-scanning is thereafter performed.

This process can be executed alone, or can also be added to that step S115 of the flowchart of FIG. 3 which is replaced with the step of judging "Is stipulated feed impossible?".

<Advantage of other Embodiment>

In this manner, even in a case where a record-scannable region is limited at a recording terminal end in a sub scanning direction, recording can be performed with a recordable region extended to the maximum and with a margin reduced to the utmost.

<Examples of Recording Apparatus to which Present Invention is Applied>

The recording apparatus of the above embodiment is suitably applicable to an ink jet printer as stated below. Here, "ink" is to be extensively interpreted, and it shall correspond with a liquid which can be used for forming an image, a design, a pattern or the like or for processing a recording medium when applied onto the recording medium.

Especially in ink-jet recording methods, it is favorable to employ a method which includes means for generating thermal energy as energy for discharging ink (for example, an electro-thermal transducer or a laser beam), and in which the status change of the ink is induced by the thermal energy.

Further, the recording apparatus according to the present invention may well take the form of a recording apparatus which is integrally or separately disposed as the image output terminal of information processing equipment such as a computer, a copying apparatus which is combined with a reader or the like, or a facsimile apparatus which has transmission and reception functions.

It shall be noted that the object of the present invention is also accomplished in such a way that a storage medium (or recording medium) which bears the program codes of software for performing the functions of each of the foregoing embodiments is supplied to a system or apparatus, and that the computer (or CPU or MPU) of the system or apparatus reads out and executes the program codes stored in the storage medium. In this case, the program codes themselves read out from the storage medium perform the functions of the embodiment, and the storage medium bearing the program codes forms the present invention. Besides, the present invention covers, not only the case where the computer executes the program codes read out to thereby perform the functions of the embodiment, but also a case where an operating system (OS) or the like operating on the computer executes part or all of actual processes on the basis of the instructions of the program codes and where the functions of the embodiment are performed through the processes.

The present invention further covers a case where, after the program codes read out from the storage medium have been written into a memory which is included in an extension card inserted into a computer or an extension unit connected to a computer, a CPU or the like which is included in the extension card or the extension unit executes part or all of actual processing on the basis of the instructions of the program codes, and where the functions of the embodiment are performed by the processing.

In case of applying the present invention to the storage medium, the program codes which correspond to the flow chart described above are stored in the storage medium.

As thus far described, according to the present invention, even in a case where a record-scannable region is limited at the end part of a recording medium in the sub scanning direction thereof, it is permitted to perform recording with a recordable region at the end part extended to the maximum and a margin reduced to the utmost.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A recording apparatus which performs recording on a recording medium while repeating a main scanning operation of record-scanning with a recording head having a plurality of recording elements arrayed in a predetermined direction, in a main scanning direction substantially orthogonal to the predetermined direction, and a sub scanning operation of relatively moving the recording head and the recording medium in a sub scanning direction orthogonal to the main scanning direction, comprising:

shift means capable of shifting, by a magnitude corresponding to a designated number of the recording elements, recording data stored in a buffer memory, and then transferring the recording data to said recording head, and control means for controlling said shift means so that, in a case where a region which cannot be record-scanned by said recording head exists in a region near an end part of said recording medium in the sub scanning direction, and where a relative position of said recording head and said recording medium in said sub scanning direction cannot be renewed, said recording data to be transferred to said recording head may be shifted by said shift means onto a side of the region which cannot be record-scanned in said sub scanning direction, wherein;

in a case where the recording is performed by relatively moving said recording medium every stipulated movement amount n in said sub scanning direction each time the record-scanning is performed in the main scanning direction by said recording head whose recording elements number N, and where said recording can be started only from a position which is shifted by a heading amount X from a front end of said recording medium in said sub scanning direction, said control means controls said shift means;

so that, in a case where an accumulative value obtained by accumulating the stipulated movement amount n from zero every record-scanning is less than the heading amount X and where a difference between said heading amount X and the accumulative value is not less than said stipulated movement amount n, such record-scannings may be repeated by shifting said recording data onto a side of the region which cannot be record-scanned in said sub scanning direction in correspondence with the difference between said heading amount X and said accumulative value by said shift means, without relatively moving said recording medium;

that, in a case where said accumulative value is less than said heading amount X and where said difference between said heading amount X and said accumulative value is less than said stipulated movement amount n, said recording medium may be relatively moved in correspondence with said difference between said heading amount X and said accumulative value after said record-scanning; and that the record-scannings may be thereafter repeated by relatively moving said recording medium every stipulated movement amount n in said sub scanning direction, without shifting said recording data by said shift means.

2. A recording apparatus as defined in claim 1, wherein:

after said recording medium has become incapable of a relative movement of said stipulated movement amount n at a rear end of said recording medium in said sub scanning direction, said control means controls said shift means;

so that, before a difference between an accumulative value obtained by accumulating a stipulated movement amount n from zero every record-scanning from a head of said recording medium and a movement execution amount from the head of said recording medium exceeds the number N of the recording elements of said recording head, such record-scannings may be repeated by shifting said recording data onto a side of the region which cannot be record-scanned in said sub scanning direction in correspondence with the difference between the accumulative value and the movement execution amount by said shift means.

3. A recording apparatus as defined in claim 1, wherein said heading amount X differs in accordance with a size of the recording medium that is used.

4. A recording apparatus, comprising:

record means for performing recording on a recording medium while repeating a main scanning operation of record-scanning with a recording head having a plurality of recording elements arrayed in a predetermined direction, in a main scanning direction substantially orthogonal to said predetermined direction, and a sub scanning operation of moving the recording medium in a sub scanning direction orthogonal to the main scanning direction;

a first paper feed port into which said recording medium is set from an upper stream side in a conveyance direction of said recording medium in a recording mode, so as to perform an edge positioning operation by conveying said recording medium in a direction the same as the conveyance direction in the recording mode;

a second paper feed port into which said recording medium is set from a lower stream side in said conveyance direction of said recording medium in said recording mode, so as to perform an edge positioning operation by conveying said recording medium in a direction reverse to said conveyance direction of said recording medium in said recording mode; and control means for performing a control in case of performing the edge positioning operation by setting said recording medium into said second paper feed port, so that, in a region which lies in a region near an end part of said recording medium on the lower stream side in said conveyance direction in said recording mode and which cannot be record-scanned by said recording head, recording data may be shifted onto a side of the region which cannot be record-scanned in the sub scanning direction and may be then transferred to said recording head.

5. A recording apparatus which performs recording on a recording medium while repeating a main scanning operation of record-scanning with a recording head having N recording elements, in a main scanning direction, and a sub scanning operation of relatively moving the recording head and the recording medium every stipulated movement amount n in a sub scanning direction orthogonal to the main scanning direction, comprising:

a first counter which stores therein a relative movement amount from a head of said recording medium;

a second counter which stores therein a logical recording position from the head of said recording medium;

shift means capable of shifting, by a magnitude corresponding to a designated number of the recording elements, a recording pattern stored in a buffer memory, and ten transferring the recording pattern to said recording head; and control means for controlling the relative movement of said recording medium, the record-scanning of said recording head, counts of the first and second counters, and the shift in said shift means;

wherein said control means performs the control: so that, at start of recording for said recording medium, the recording may be started upon relatively moving said recording medium to a position which is shifted onto a lower stream side in a moving direction, by a heading amount X from top edge of said medium, and setting said first counter and said second counter at X and "0", respectively;

that, at every record-scanning, in a case where values of said first counter and said second counter are equal, a regular recording may be performed, and in a case where the values are not equal, the record-scanning may be performed by shifting the recording data onto the lower stream side in the moving direction, in correspondence with a difference d between the values of the first and second counters by said shift means; and that after the record-scanning, in a case where the difference d is less than the stipulated movement amount n, (n−d) may be added to the value of said first counter by moving said recording medium by (n−d) in the sub scanning direction, that, in a case where said difference d is not less than said stipulated movement amount n, the movement control may be performed so as not to perform the relative movement operation of said recording medium in said sub scanning direction, and that said second counter may add up the stipulated movement amounts n irrespective of existence or non-existence or a movement amount of said movement operation of said recording medium.

6. A recording apparatus as defined in claim 5, wherein said control means performs said control so as not to perform said record-scanning in the processing of every record-scanning, in a case where said difference d between said values of said first counter and said second counter is not less than the number N of said recording elements of said recording head.

7. A recording apparatus as defined in claim 5, further comprising a first paper feed port into which said recording medium is set from an upper stream side in a conveyance direction of said recording medium in a recording mode, so as to perform an edge positioning operation by conveying said recording medium in a direction the same as the conveyance direction in the recording mode, and a second paper feed port into which said recording medium is set from a lower stream side in said conveyance direction of said recording medium in said recording mode, so as to perform an edge positioning operation by conveying said recording medium in a reverse direction to said conveyance direction of said recording medium in said recording mode;

wherein the heading amount X differs depending upon the sort of the paper feed port that is used.

8. A method of controlling a recording apparatus which performs recording on a recording medium while repeating a main scanning operation of record-scanning a recording head having a plurality of recording elements arrayed in a predetermined direction, in a main scanning direction substantially orthogonal to the predetermined direction, and a sub scanning operation of relatively moving the recording head and the recording medium in a sub scanning direction orthogonal to the main scanning direction, comprising a control step including the step of:

shifting recording data onto a side of a region which cannot be record-scanned in the sub scanning direction, by a magnitude corresponding to a designated number of the recording elements, and then transferring the recording data to the recording head, in a case where the region which cannot be record-scanned by said recording head exists in a region near an end part of the recording medium in said sub scanning direction, and where a relative position of said recording head and said recording medium in said sub scanning direction cannot be renewed, wherein:

in a case where the recording is preformed by relatively moving said recording medium every stipulated movement amount n in said sub scanning direction each time the record-scanning is performed in the main scanning direction by said recording head whose recording elements number N, and where the print recording can be started only from a position which is shifted by a heading amount X from a front end of said recording medium in said sub scanning direction, said control step proceeds;

so that, in a case where an accumulative value obtained by accumulating the stipulated movement amount n from zero every record-scanning is less than the heading amount X and where a difference between said heading amount X and the accumulative value is not less than said stipulated movement amount n, such record-scannings may be repeated by shifting said recording data onto a side of the region which cannot be record-scanned in said sub scanning direction in correspondence with the difference between said heading amount X and said accumulative value by said shift means, without relatively moving said recording medium;

that, in a case where said accumulative value is less than said heading amount X and where said difference between said beading amount X and said accumulative value is less than said stipulated movement amount n, said recording medium may be relatively moved in correspondence with said difference between said heading amount X and said accumulative value after said record-scanning; and that the record-scannings may be thereafter repeated by relatively moving said recording medium every stipulated movement amount n in said sub scanning direction, without shifting said recording data by said shift means.

9. A method of controlling a recording apparatus as defined in claim 8, wherein:

after said recording medium has become incapable of the relative movement of said stipulated movement amount n at a rear end of said recording medium in said sub scanning direction, said control step proceeds;

so that, before a difference between an accumulative value obtained by accumulating a stipulated movement amount n from zero every record-scanning from a head of said recording medium and a movement execution amount from the head of said recording medium exceeds the number N of the recording elements of said recording head, such record-scannings may be repeated by shifting said recording data onto a side of the region which cannot be record-scanned in said sub scanning direction in correspondence with the difference between the accumulative value and the movement execution amount by said shift means.

10. A method of controlling a recording apparatus as defined in claim 9, wherein the recording apparatus further has a first paper feed port into which said recording medium is set from an upper stream side in a conveyance direction of said recording medium in a recording mode, so as to perform an edge positioning operation by conveying said recording medium in a direction the same as the conveyance direction in the recording mode, and a second paper feed port into which said recording medium is set from a tower stream side in said conveyance direction of said recording medium in said recording mode, so as to perform an edge positioning operation by conveying said recording medium in a reverse direction to said conveyance direction of said recording medium in the print recording mode; and wherein a heading amount X differs depending upon the sort of the paper feed port that is used, at said control step.

11. A method of controlling a recording apparatus as defined in claim 8, wherein said heading amount X differs in accordance with a size of the recording medium to-be-used that is used, at said control step.

12. A storage medium in which a control program that executes the method defined in claim 8 is stored in a computer-readable manner.

13. A method of controlling a recording apparatus, having:

a first paper feed port into which a recording medium is set from an upper stream side in a conveyance direction of the recording medium in a recording mode, so as to perform an edge positioning operation by conveying said recording medium in a direction the same as the conveyance direction in the recording mode; a second paper feed port into which said recording medium is set from a lower stream side in said conveyance direction of said recording medium in said recording mode, so as to perform an edge positioning operation by conveying said recording medium in a direction reverse to said conveyance direction of said recording medium in said recording mode; and recording means for performing recording on said recording medium while repeating a main scanning operation of record-scanning a recording head having a plurality of recording elements arrayed in a predetermined direction, in a main scanning direction substantially orthogonal to said predetermined direction, and a sub scanning operation of moving said recording medium in a sub scanning direction orthogonal to the main scanning direction; comprising the step of:

performing a control in case of performing the edge positioning operation by setting said recording medium into said second paper feed port, so that, in a region which lies in a region near an end part of said recording medium on the lower stream side in said conveyance direction in said recording mode and which cannot be record-scanned by the recording head, recording data may be shifted onto a side of the region which cannot be record-scanned in the sub scanning direction and may be then transferred to said recording head.

14. A method of controlling a recording apparatus which performs recording on a recording medium while repeating a main scanning operation of record-scanning with a recording head having N recording elements, in a main scanning direction, and a sub scanning operation of relatively moving the recording head and the recording medium every stipulated movement amount n in a sub scanning direction orthogonal to the main scanning direction, and which has:

a first counter which stores therein a relative movement amount from a head of said recording medium;

a second counter which stores therein a logical recording position from the head of said recording medium; and shift means capable of shifting, by a magnitude corresponding to a designated number of the recording elements, a recording pattern stored in a buffer memory, and then transferring the recording pattern to said recording head; comprising:

the control step of controlling the relative movement of said recording medium, the record-scanning of said recording head, counts of the first and second counters, and the shift in said shift means;

wherein said control step performs the control: so that, at start of recording for said recording medium, the recording may be started upon relatively moving said recording medium to a position which is shifted onto a lower stream side in a moving direction, by a heading amount X from top edge of said medium, and setting said first counter and said second counter at X and "0", respectively;

that, at every record-scanning, in a case where values of said first counter and said second counter are equal, a regular recording may be performed, and in a case where the values are not equal, the record-scanning may be performed by shifting the recording data onto the lower stream side in the moving direction, in correspondence with a difference d between the values of the first and second counters by said shift means; and that, after the record-scanning, in a case where the difference d is less than the stipulated movement amount n, (n−d) may be added to the value of said first counter by moving said recording medium by (n−d) in the sub scanning direction, that, in a case where said difference d is not less than said stipulated movement amount n, the movement control may be performed so as not to perform the relative movement operation of said recording medium in said sub scanning direction, and that said second counter may add up the stipulated movement amounts n irrespective of existence or nonexistence or a movement amount of said movement operation of said recording medium.

15. A method of controlling a recording apparatus as defined in claim 13, wherein said control step performs said control so as not to perform said record-scanning in the processing of every record-scanning, in a case where said difference d between said values of said first counter and said second counter is not less than the number N of said recording elements of said recording head.

* * * * *